US007464501B2

(12) United States Patent
Arimoto et al.

(10) Patent No.: US 7,464,501 B2
(45) Date of Patent: Dec. 16, 2008

(54) SLIDING WINDOW ASSEMBLY

(75) Inventors: Shigeki Arimoto, Bloomfield, MI (US); Louis William Berklich, Jr., Lake Orion, MI (US); Beau James Cook, Jr., Holly, MI (US)

(73) Assignee: Hi-Lex Corporation, Troy, MI (US)

( * ) Notice: Subject to any disclaimer, the term of this patent is extended or adjusted under 35 U.S.C. 154(b) by 574 days.

(21) Appl. No.: 10/915,242

(22) Filed: Aug. 10, 2004

(65) Prior Publication Data

US 2006/0032140 A1 Feb. 16, 2006

(51) Int. Cl.
*E05D 15/06* (2006.01)

(52) U.S. Cl. ..... 49/413; 49/209; 49/210

(58) Field of Classification Search ..... 49/209, 49/211, 213, 216, 221, 413, 210, 120, 118, 49/360

See application file for complete search history.

(56) References Cited

U.S. PATENT DOCUMENTS 2,752,642 A * 7/1956 Starck et al. ..... 49/181
4,158,270 A 6/1979 Cherbourg et al. ..... 49/103
4,862,640 A * 9/1989 Boyko et al. ..... 49/213
4,887,390 A * 12/1989 Boyko et al. ..... 49/214
4,920,698 A 5/1990 Friese et al. ..... 49/380
5,309,675 A * 5/1994 Shen et al. ..... 49/214
5,542,214 A * 8/1996 Buening ..... 49/380
5,784,833 A 7/1998 Sponable et al. ..... 49/360
6,018,913 A 2/2000 Lin ..... 49/414
6,119,401 A 9/2000 Lin et al. ..... 49/361
6,125,585 A 10/2000 Koneval et al. ..... 49/349
6,324,788 B1 12/2001 Koneval et al. ..... 49/121

* cited by examiner

*Primary Examiner*—Gregory J. Strimbu
(74) *Attorney, Agent, or Firm*—Young Basile

(57) ABSTRACT

A sliding window assembly for use with a motor vehicle such as the rear window of the cab of a pickup type truck. A guide structure mounts a sliding pane for longitudinal sliding movement generally parallel to the plane of the pane between an open position and a closed position, and a lateral thrust mechanism is provided to move the pane laterally relative to the plane of the pane into the closed position wherein the exposed face of the pane is flush with a surrounding vehicle surface.

11 Claims, 12 Drawing Sheets

FIG - 10
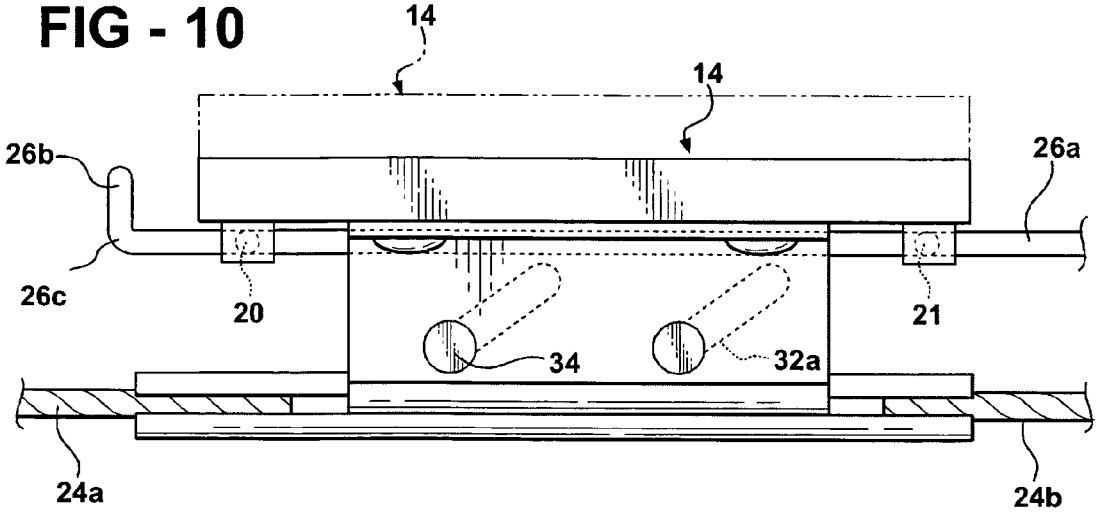
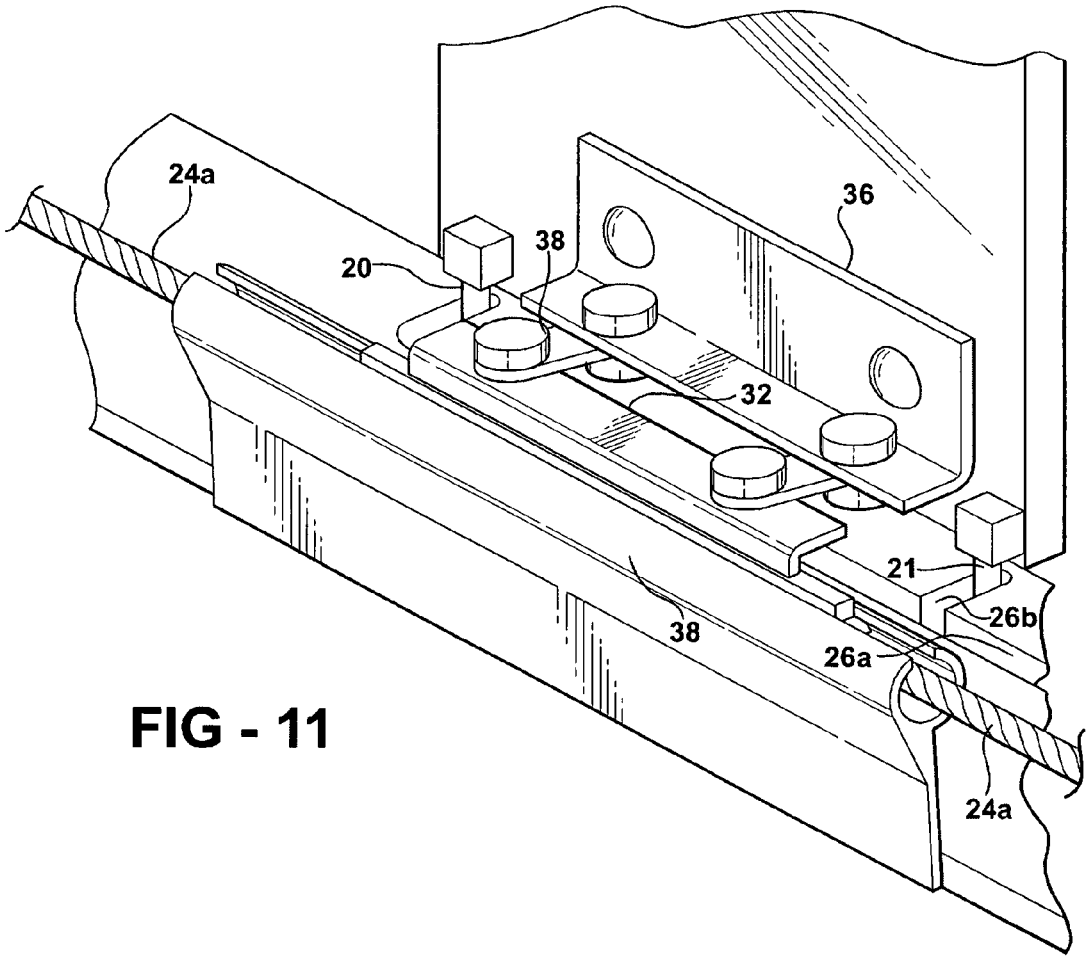
FIG - 11

FIG - 12
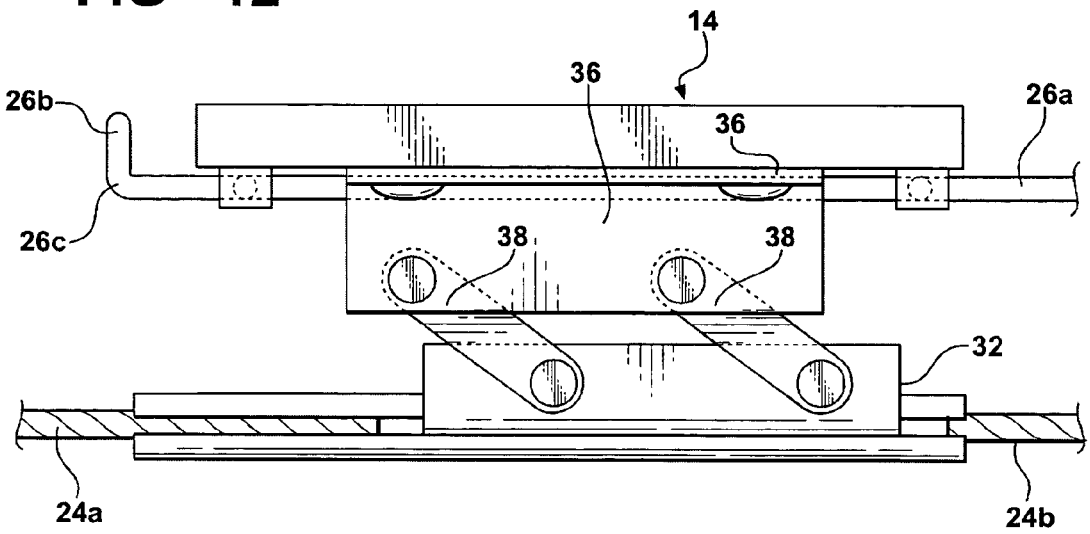
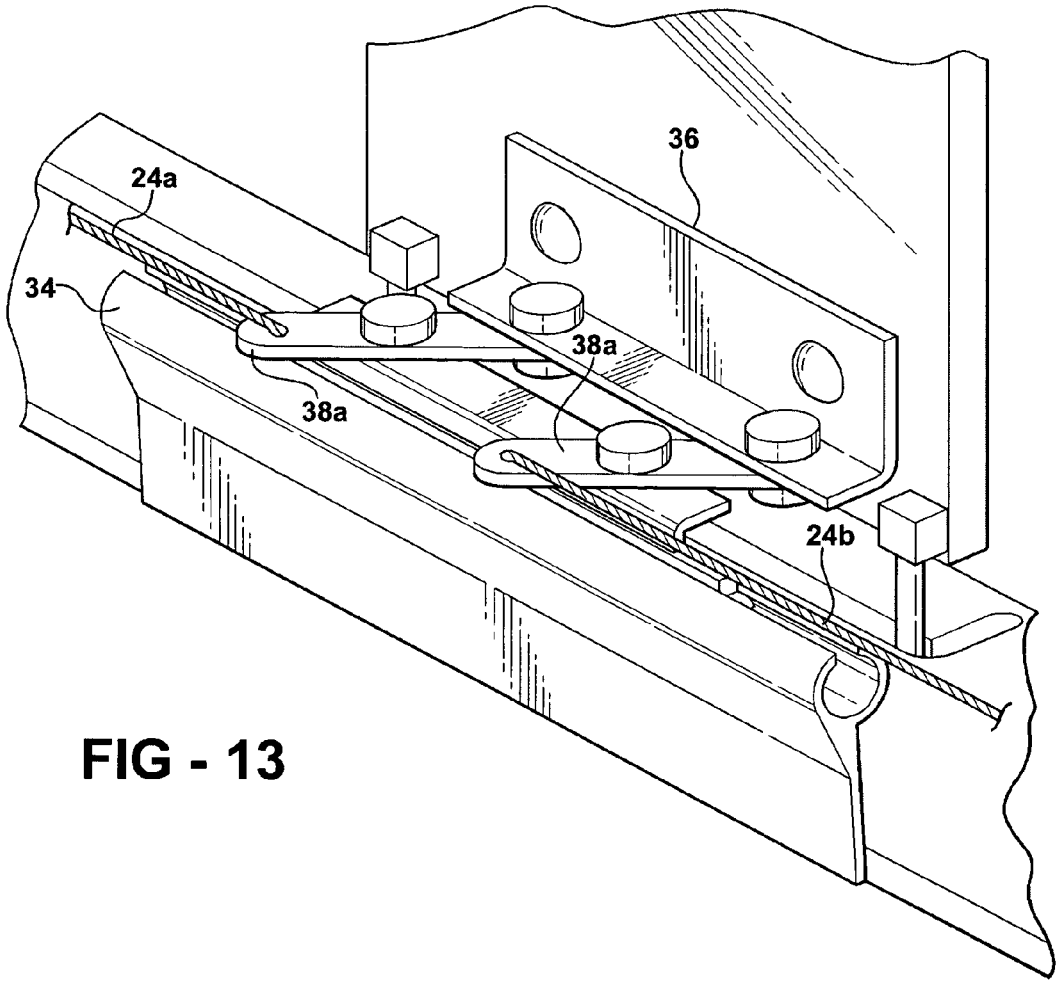
FIG - 13

FIG - 16
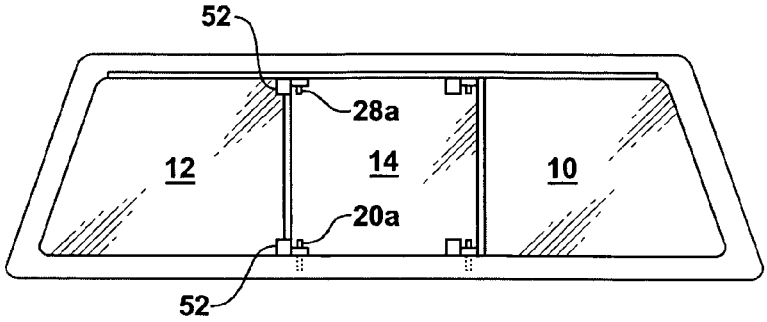
FIG - 17a
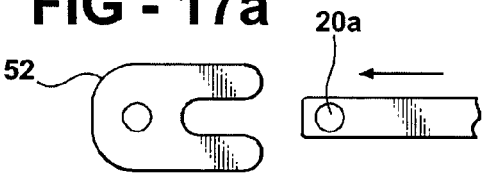
FIG - 17b
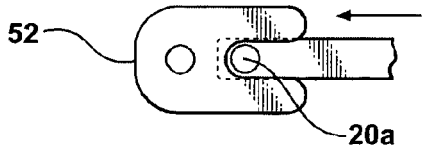
FIG - 17c
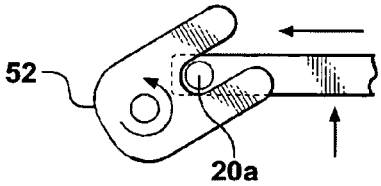
FIG - 17d
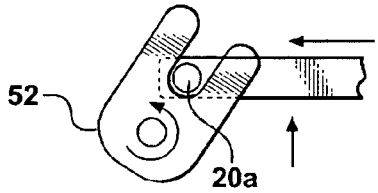
FIG - 17e
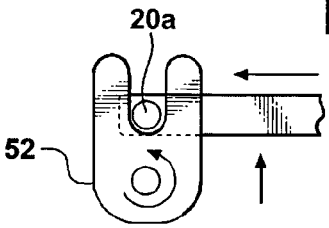
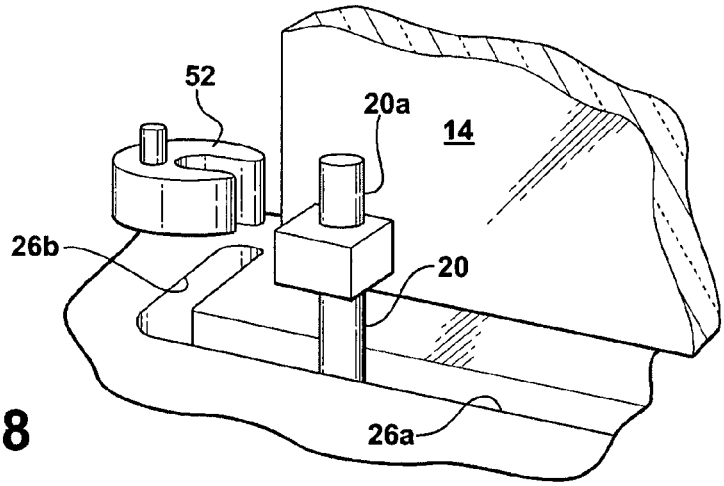
FIG - 18

FIG - 19
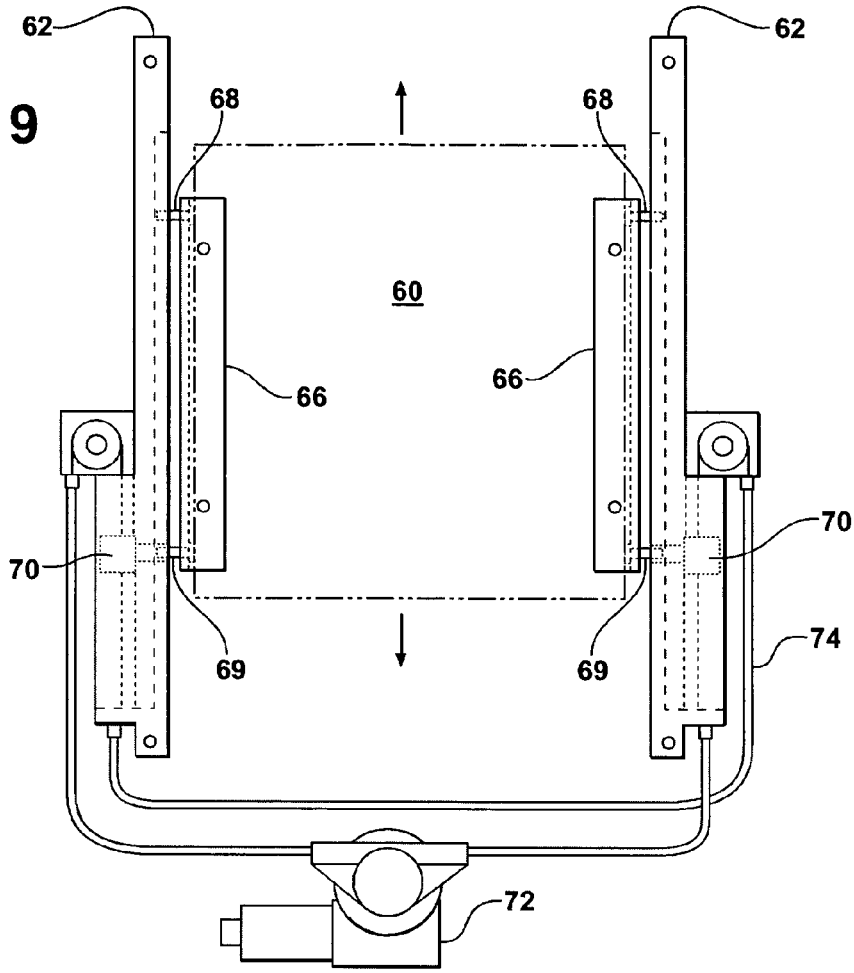
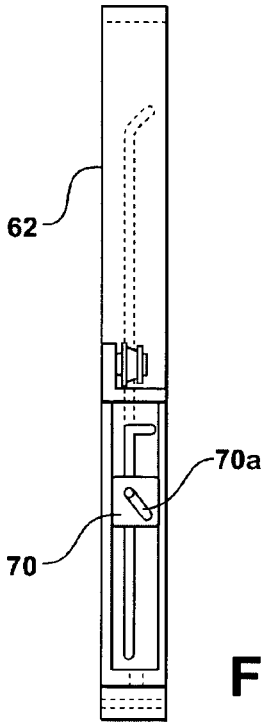
FIG - 20
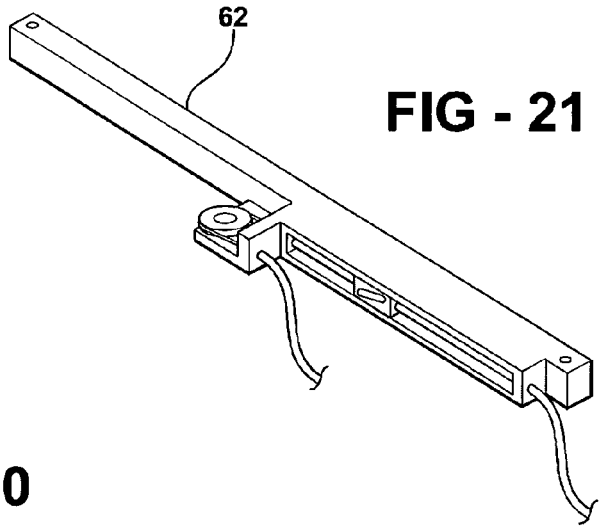
FIG - 21

SLIDING WINDOW ASSEMBLY

BACKGROUND OF THE INVENTION

This invention relates to motor vehicle window assemblies and more particularly to a motor vehicle window assembly including a sliding glass pane moveable between open and closed positions.

There are many motor vehicle applications wherein it is desirable to move a glass pane in a sliding fashion between an open and a closed position. For example, the rear window in a pickup type truck may comprise fixed left and right glass panels and a sliding panel adapted to move between an open position behind one of the fixed glass panels and a closed position in which it is positioned between the fixed panels to seal the window opening.

Many arrangements have been proposed to facilitate the sliding movement of the sliding glass pane between its open and closed positions. However, none of the prior art arrangements have had the ability to move the sliding glass pane in its closed position to a position wherein the face of the sliding glass pane is flush with the face of the fixed glass panes.

SUMMARY OF THE INVENTION

This invention is directed to an improved sliding window assembly for motor vehicle applications.

More particularly, this invention is directed to the provision of a sliding motor vehicle window assembly wherein the sliding pane in its closed position may assume a position flush with surrounding glass or other vehicular surface.

The sliding window assembly according to the invention comprises a glass pane, a guide structure mounting the pane for longitudinal sliding movement generally parallel to the plane of the pane between an open position and a closed position, and a lateral thrust mechanism operative in response to arrival of the pane at its closed position to thereafter move the pane laterally relative to the plane of the pane. This arrangement allows the glass to be moved longitudinally to its closed position and thereafter moved laterally to a position flush with the fixed adjacent vehicle surface.

According to a further feature of the invention, the guide structure includes a fixed guide structure; a moveable guide structure slidably mounted in the fixed guide structure; at least one guide pin secured to the pane; a compound slot receiving the pin; and a drive mechanism interconnecting the glass pane and the moveable guide structure and operative with the pin positioned in a first portion of the compound slot to move the glass pane along the fixed guide structure in a longitudinal direction generally parallel to the plane of the pane and operative with the pin positioned in a second portion of the compound slot to move the glass pane laterally relative to the plane of the pane. This specific guide structure facilitates the compound movement of the glass pane to its flush position.

According to a further feature of the invention, the first portion of the compound slot comprises an elongated primary portion generally parallel to the plane of the glass pane and the second portion of the compound slot comprises an end portion extending at an angle to the primary portion. This specific slot configuration further facilitates the compound movement of the glass pane.

According to a further feature of the invention, the compound slot has an "L" configuration with the primary portion constituting one leg of the "L" and the end portion constituting another leg of the "L."

In one embodiment of the invention, the compound slot is defined by a fixed guide structure; the moveable guide structure comprises a slider slidably mounted in the fixed guide structure; a first portion of the pin is received in the compound slot; and a second portion of the pin is received in a slot defined by the slider and angled with respect to the portion of the compound slot.

In further embodiments of the invention, the drive mechanism comprises linkage interconnecting the glass pane and the moveable guide structure. The linkage may comprise a parallel linkage including a pair of parallel links or may comprise a scissors linkage interconnecting the glass pane and the moveable guide structure.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIGS. 9 and 10 are fragmentary perspective and fragmentary plan views of an alternate embodiment of the invention;

FIGS. 11 and 12 are fragmentary perspective and fragmentary plan views of a further alternate embodiment of the invention;

FIG. 13 is a fragmentary perspective view of a yet further alternate embodiment of the invention;

FIGS. 16, 17 and 18 are views of a yet further embodiment of the invention; and FIGS. 19-22 are views showing the application of the invention to a motor vehicle sunroof.

DETAILED DESCRIPTION OF THE PREFERRED EMBODIMENT

The embodiments of the invention illustrated in FIGS. 1-18 relate to the application of the invention to a sliding window assembly constituting the rear window in the cab of a pickup type motor vehicle.

Figure 1:
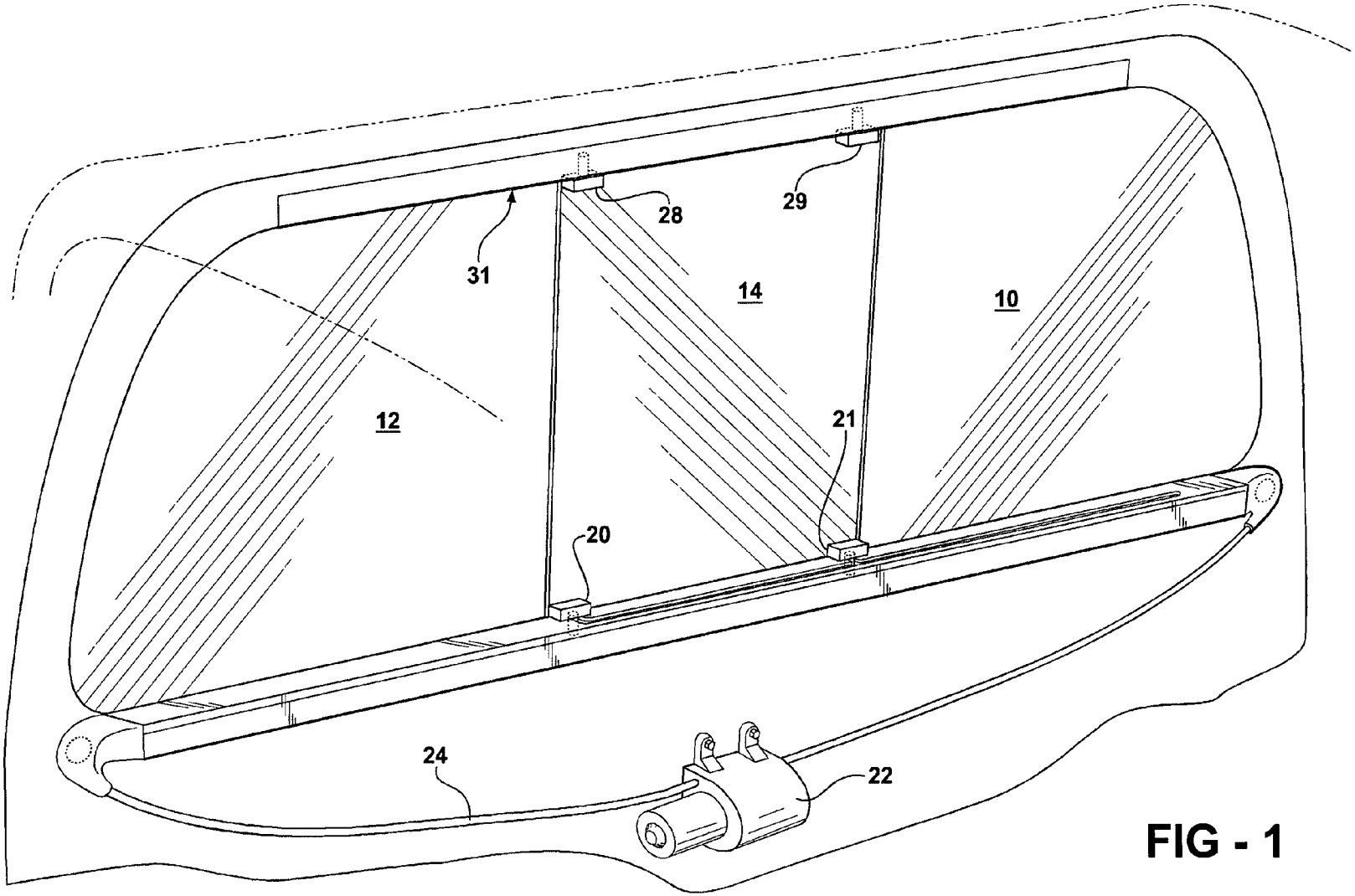
FIG. 1 is a perspective view of a sliding window assembly according to the invention shown employed to provide a sliding rear window assembly for a pickup truck.
Figure 2:
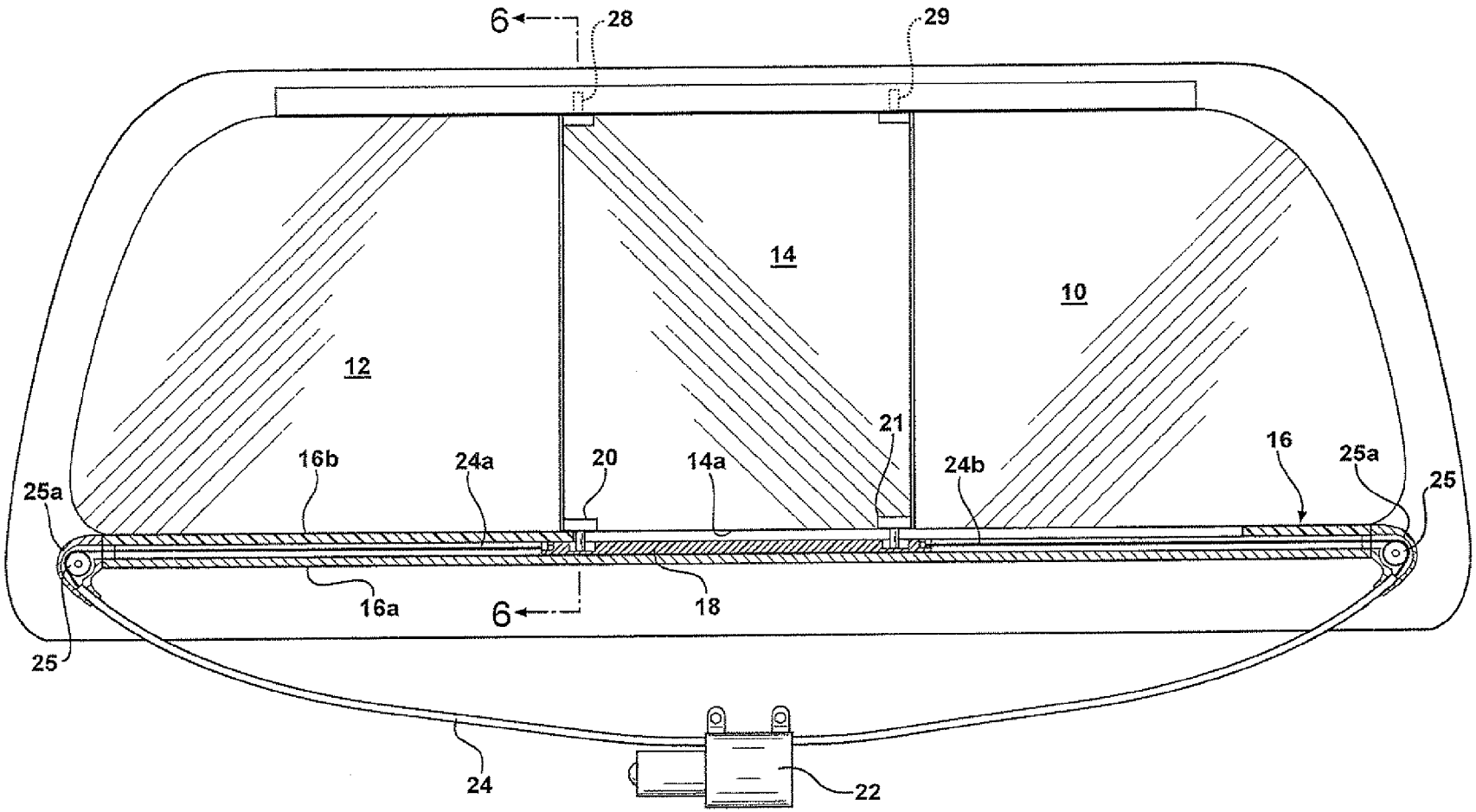
FIG. 2 is an elevational view of the sliding window assembly of FIG. 1.
Figure 3:
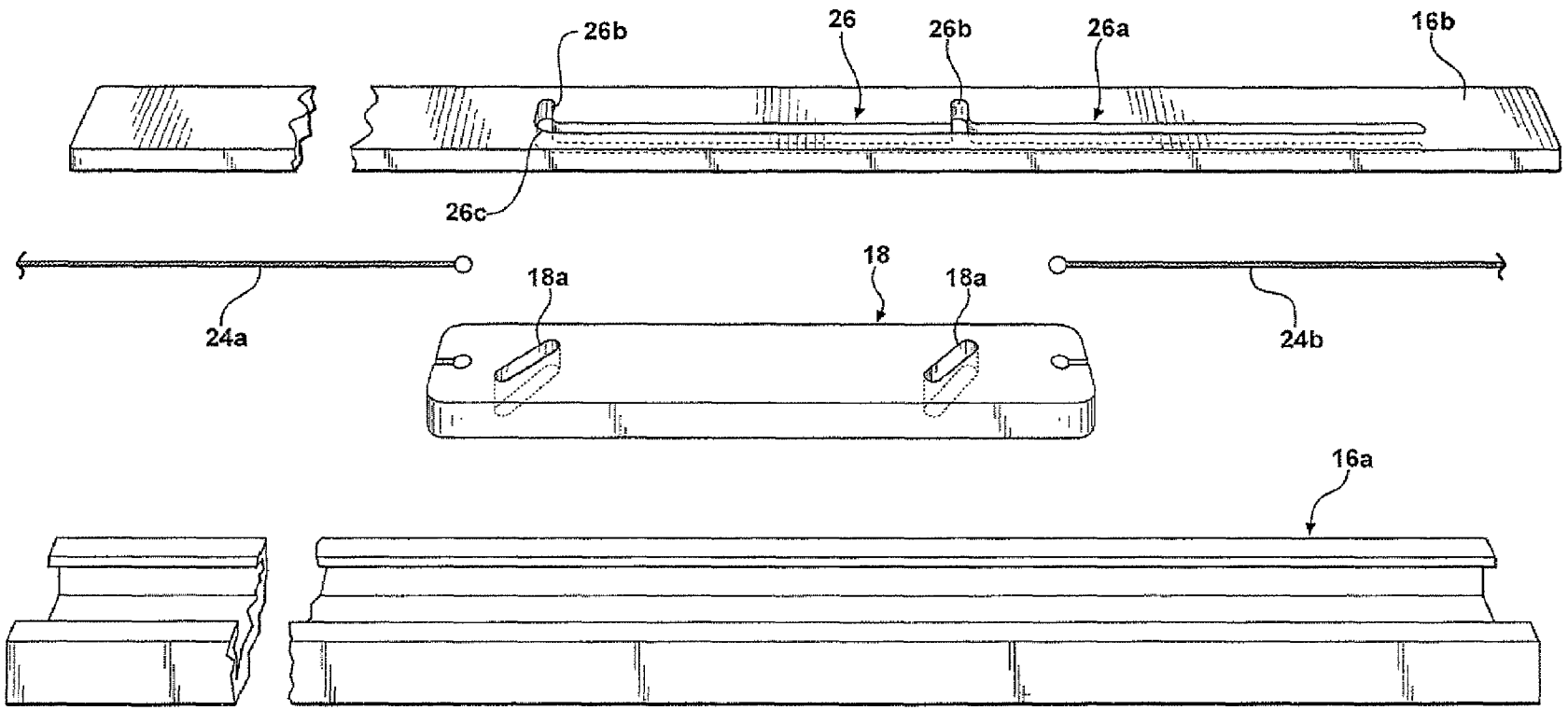
FIG. 3 is a view showing, in exploded perspective form, component parts of the sliding window assembly of FIGS. 1-2.

With reference to FIGS. 1-8, the sliding window assembly of the invention is seen embodied as the rear window of the cab of a pickup type motor vehicle with FIGS. 1 and 2 being taken from inside the cab looking rearwardly.

The rear window assembly seen in FIGS. 1 and 2 comprises, broadly considered, a left fixed window pane 10, a right fixed window pane 12, and a moveable or sliding window pane 14 adapted to be moved between the closed position seen in FIGS. 1 and 2, in which it is positioned between fixed panes 10 and 12 to close the rear window assembly, and an open position in which it is positioned forward of the fixed pane 10.

The movement of the sliding pane 14 between its open and closed position is accomplished utilizing a mechanism comprising a fixed guide structure in the form of a track 16 positioned within the cab along the lower edge of the glass panes and comprising a lower channel member 16*a* and an upper slot plate 16*b* suitably secured to the channel member; a moveable guide structure in the form of a slider 18 positioned slidably in channel member 16*a*; a pair of pins 20/21 secured at longitudinally spaced locations to a lower edge 14*a* of the sliding pane 14; and a power mechanism including an electric motor 22 positioned within the cab and driving a cable 24 secured at its opposite ends 24*a* and 24*b* to opposite ends of slider 18. Cable ends 24*a*, 24*b* are trained around pulleys 25 mounted in pulley housings 25*a* secured to opposite ends of track 16.

A compound slot 26 is defined by slot plate 16*b* including a primary slot portion 26*a* extending generally parallel to the plane of the glass panes and lateral portions 26*b* extending rearwardly at generally right angles from the primary portion 26*a*.

A pair of longitudinally spaced, oblique slots 18*a* are provided in slider 18.

Pins 20/21, slot portions 26*b*, and slots 18*a* have identical longitudinal spacing.

In the assembled relation of the parts, pins 20/21 extend downwardly thorough slot 26*a* for receipt in respective oblique slots 18*a*.

In operation, and with the sliding pane 14 initially in an open position forward of the fixed pane 10, pins 20/21 extend downwardly though the primary portion 26*a* of slot 26 for receipt in the forward end of respective oblique slots 18*a*.

Figure 4:
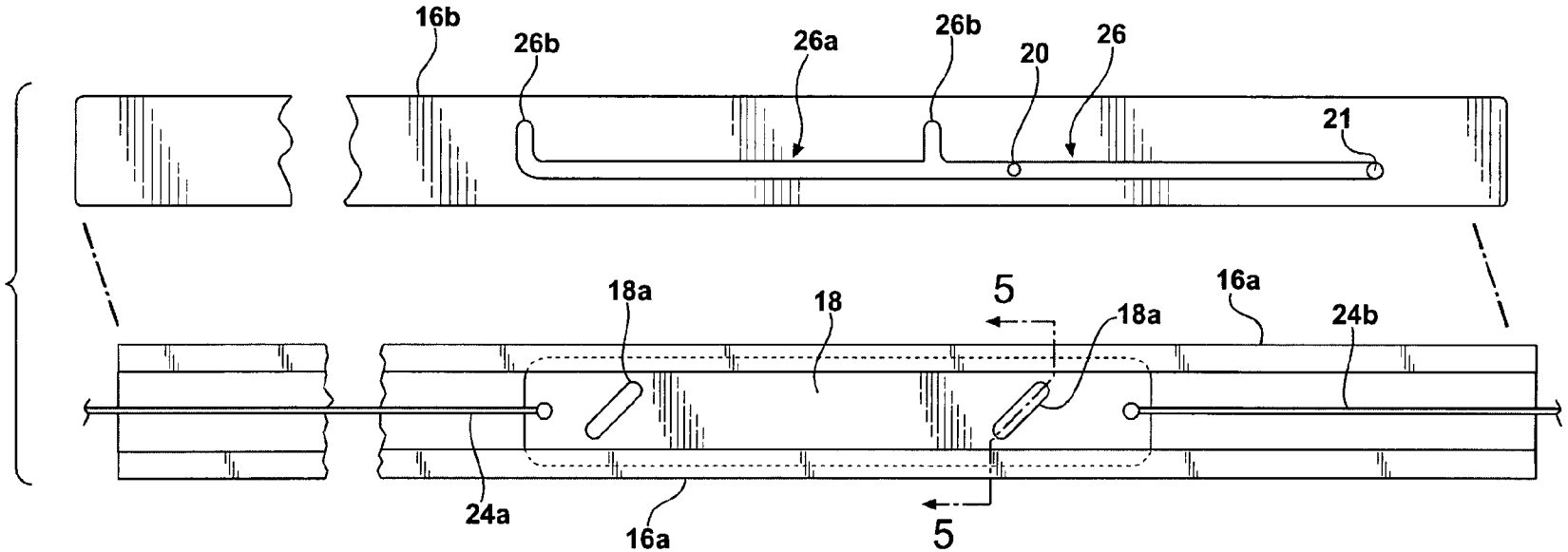
FIG. 4 is a further exploded view of component parts of the sliding window assembly.
Figure 8:
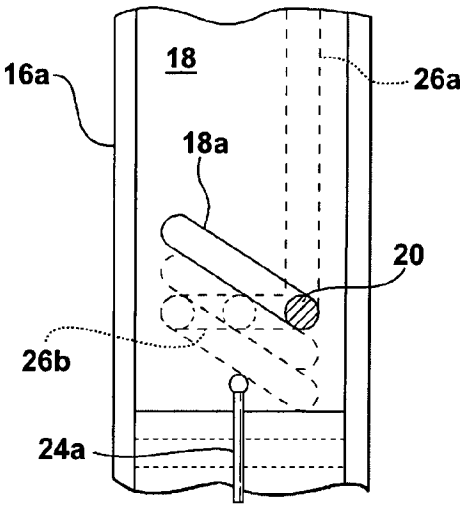
FIG. 8 is a fragmentary somewhat schematic plan view further illustrating the lateral, translatory movement of the glass.
Figure 5:
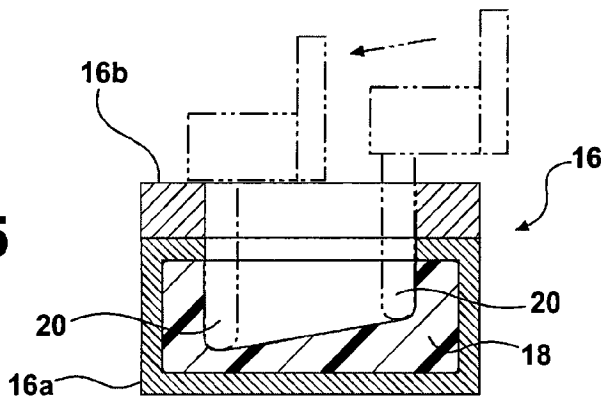
FIG. 5 is a cross-sectional view taken on line 5-5 of FIG. 4.
Figure 6:
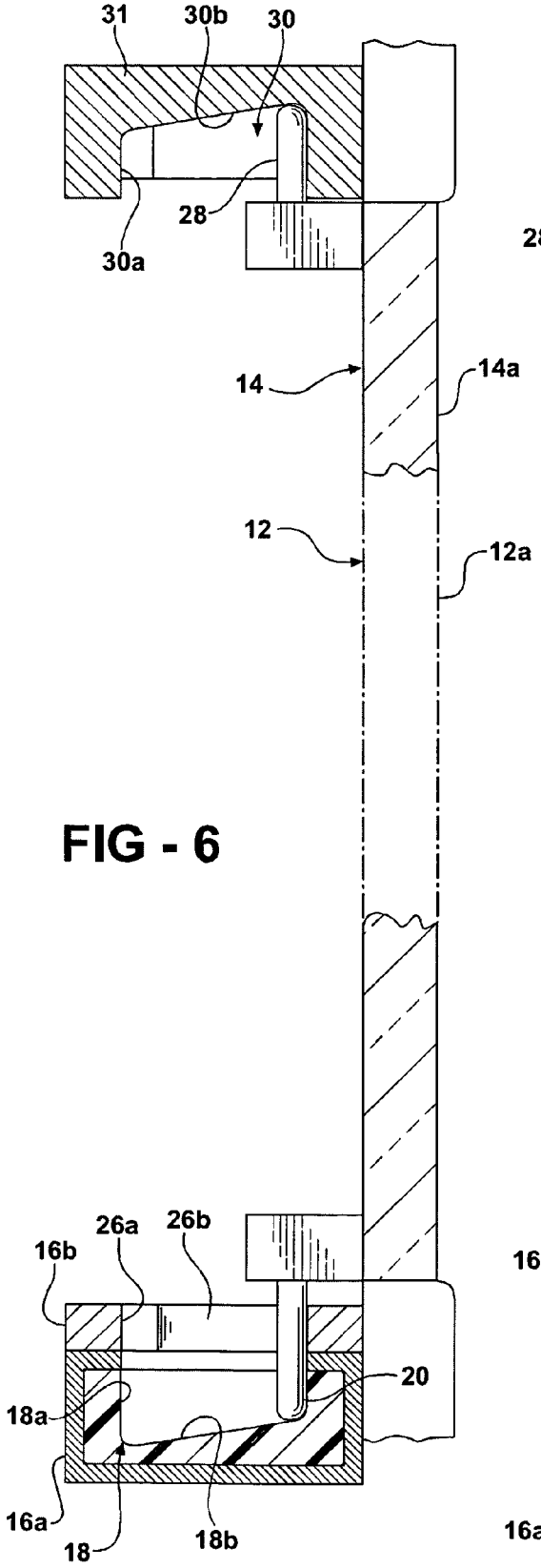
FIGS. 6 and 7 are cross-sectional views taken along line 6-6 in FIG. 2, FIG. 6 showing the sliding window in a closed position, FIG. 7 showing the sliding window in an unclosed position.
Figure 7:
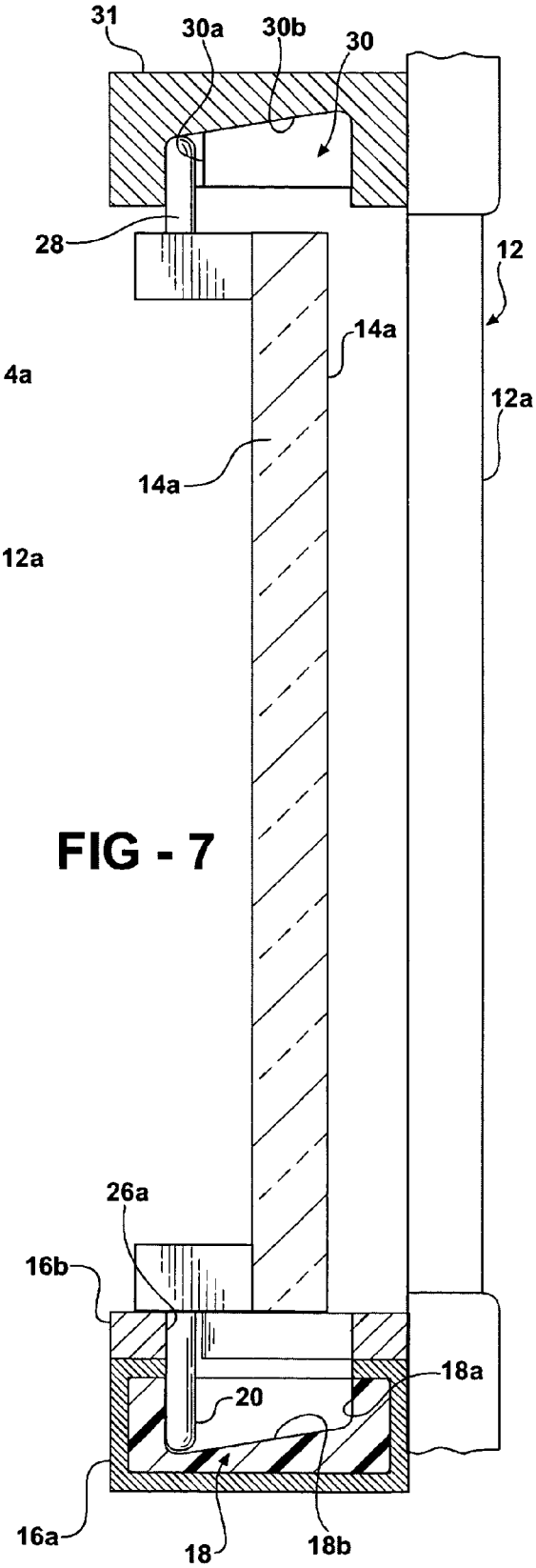

To move the window from the open position to the closed position between the fixed panes 10 and 12, motor 22 is actuated in a sense to drive the cable ends 24*a* and 24*b* in a sense to move the slider 18 leftwardly as viewed in FIG. 4. As the slider moves leftwardly, the sliding pane 14 is carried with the slider by virtue of the positioning of the pins 20/21 in the primary slot 26*a* and in the forward ends of the oblique slots 18*a*. This leftward longitudinal sliding movement of the slider continues until the leading pin 20 reaches the end 26*c* of the primary slot 26*a* at which point the window is positioned generally between the fixed panes 10 and 12. At this point no further longitudinal sliding movement of the window is possible by virtue of the dead ending of the pin 20 in the end 26*c* of the slot 26. A limited amount of further leftward longitudinal sliding movement of the slider continues with the effect of camming the pins 20/21 rearwardly into the secondary slot portions 26*b* by virtue of the oblique configuration of the slots 18*a* relative to the slots 26*b*. As the pins 20/21 move rearwardly in slot portions 26*b* the pane 14 is moved laterally and rearwardly into a position between fixed panes 12 and 10 and specifically into a position, seen in FIG. 6, in which the outer or rearward surface 14*a* of the pane is flush with the outer or rearward surfaces 10*a*/12*a* of the fixed panes 10 and 12.

Preferably, the sliding glass assembly further includes upper pins 28 and 29 carried on an upper edge of the sliding pane and guiding in a compound slot 30 in an upper fixed guide 31. Slot 30 has longitudinal and lateral portions 30*a*, 30*b* corresponding in configuration to the slot portions 26*a*, 26*b* of the slot 26 in slot plate 16.

Further, preferably, sliding pane 14 is moved upwardly slightly as it is moved laterally rearwardly and this upward movement is accomplished by providing an angled bottom 18*b* to the slots 18*a* in slider 18 and providing a complementary upwardly angled "bottom" to the slots 30*b* in the upper guide structure 31. The upward movement of the glass as it moves rearwardly has been found to provide a more positive sealing action of the glass as it moves into its closed position and also deters breaking into the vehicle through the rear window of the cab since any attempted unauthorized inward or forward movement of the pane 14 is resisted by the wedging interference fit between the upper pins 28/29 and the angled surfaces 30*b*.

Movement of the sliding pane back to its open position is of course accomplished by reversal of the motor 22 with a reversed movement of the cable ends 24*a*, 24*b* with the initial movement of the slider to the right as viewed in FIG. 4 having the effect of camming the pins 20/21 forwardly out of the secondary slots 26*b* and into the primary slot 26*a* whereafter further sliding movement of the slider 18 to the right moves the pane 14 back to its open position behind the fixed pane 10.

Figure 9:
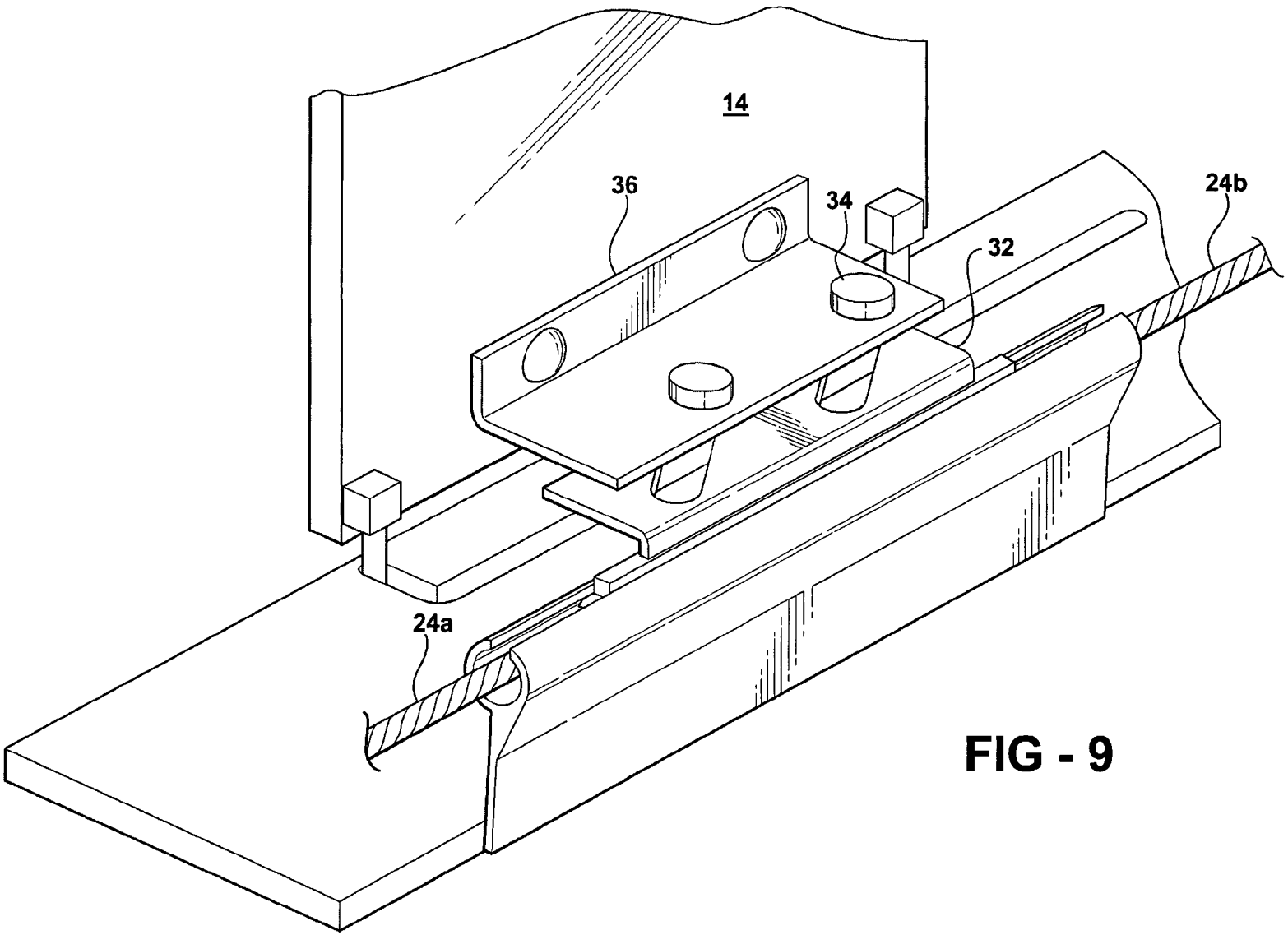

In the modified form of the invention seen in FIGS. 9 and 10, pins 20, 21 continue to glide in a compound slot 26*a*/26*b*, (in this case defined by a fixed guide member 33) but the moveable guide member now takes the form of an angled slider plate 32 slidably mounted in a tubular guide 34 and connected to cable ends 24*a*, 24*b*. Slider plate 32 defines oblique slots 32*a* corresponding to slots 18*a* in the FIGS. 1-8 embodiment and the slots respectively receive pins 34 carried by an angle bracket 36 secured to the lower edge of the sliding glass pane 14. In the operation of this embodiment of the invention, as the window moves from its open to its closed position, pins 20/21 track in slot 26*a* and pins 34 are received in the forward ends of slots 32*a* until the pane arrives at a position generally between the fixed glass panes whereupon the pin 20 bottoms in the end 26*c* of slot 26*a* and the oblique slots 32*a* thereafter coact with the pins 34 to slide the glass rearwardly and laterally into a flush position relative to the fixed panes with the pins 20/21 moving into the secondary slot portions 26*b* to accommodate this rearward lateral movement.

The embodiment seen in FIGS. 11 and 12 is generally similar to the embodiment of FIGS. 9-10 with the exception that the pin and slot connection 32*a*/34 of the FIG. 9/10 embodiment is replaced by a parallel linkage consisting of links 38 pivotally interconnecting the slider 32 and the glass bracket 36 so that as the pin 20 reaches the end 26*c* of the primary slot portion 26*a*, continued longitudinal sliding movement of the slider has the effect of straightening out the links 38 and moving the glass pane rearwardly and laterally into a flush position with respect to the fixed panes with, again, the rearward lateral movement being accompanied by and accommodated by movement of the pins 20, 21 into the secondary, rearwardly extending slot portions 26*b*.

The embodiment seen in FIG. 13 is generally similar to the FIGS. 11/12 embodiment with the exception that the cable ends 24*a*/24*b*, rather than being secured to opposite ends of the slider plate 32, are secured to forward extensions 38*a* of the parallel links 38 with the structure of the assembly otherwise corresponding to the FIGS. 11/12 embodiment and the operation otherwise corresponding to the FIGS. 11/12 embodiment.

Figure 14:
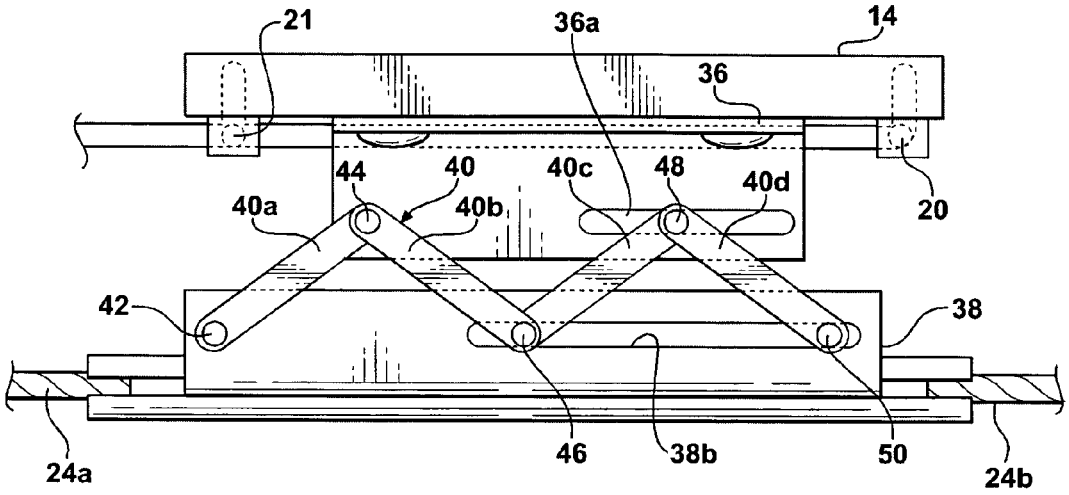
FIGS. 14 and 15 are fragmentary plan views of a yet further embodiment of the invention.
Figure 15:
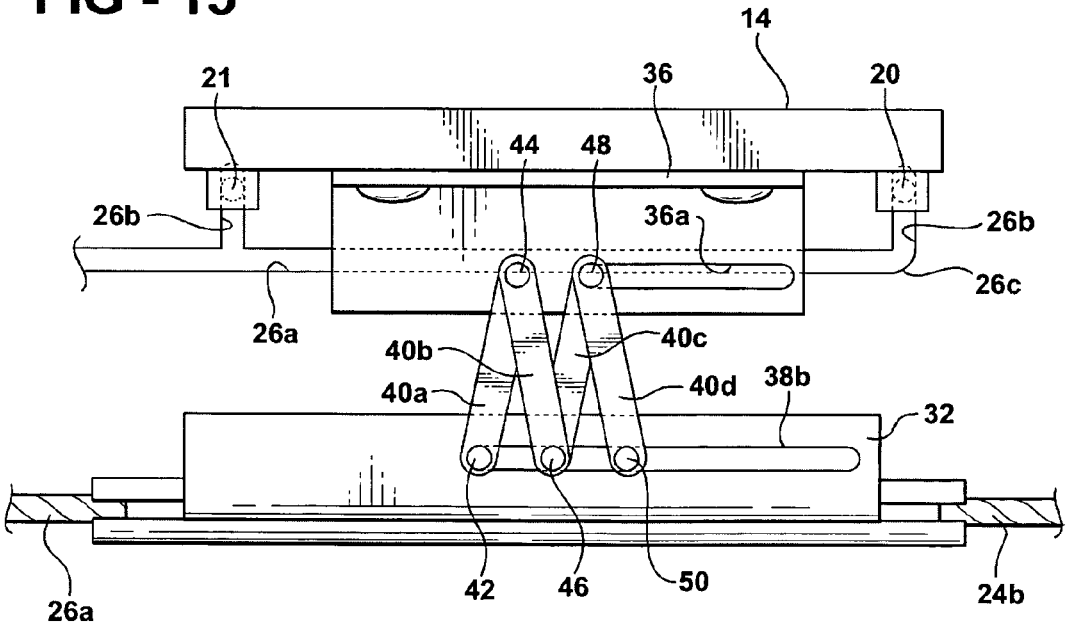
Figure 22:
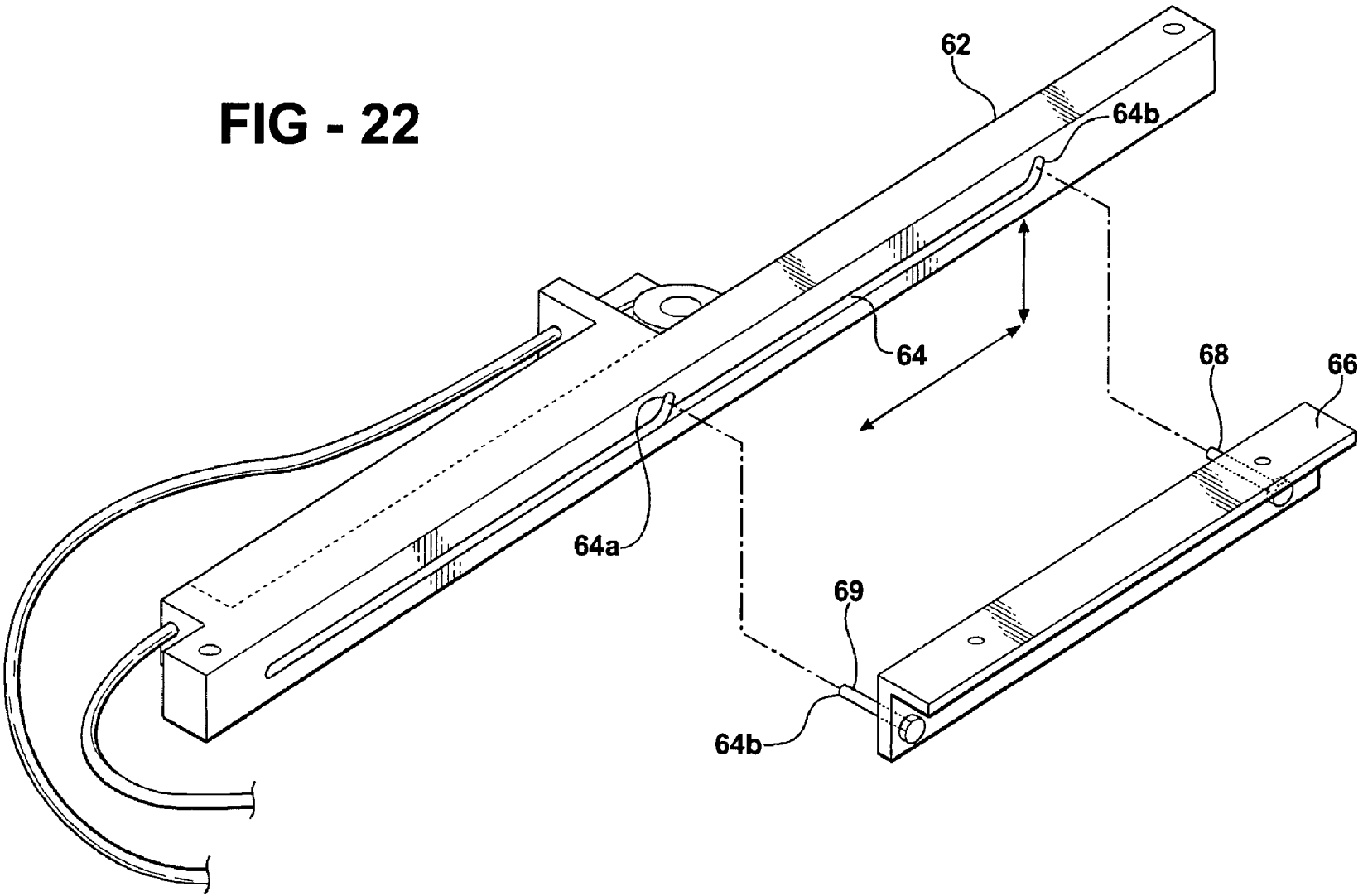

In the embodiment of FIGS. 14 and 15, the parallel links 38 interconnecting the slider plate 38 and the glass bracket 36 are replaced with a scissors linkage 40 comprising links 40*a*, 40*b*,

40*c* and 40*d*. Link 40*a* is pivoted to slide plate 38 by a pin 42; links 40*a* and 40*b* are pivotally interconnected by a pin 44; links 40*b* and 40*c* are pivotally interconnected by a pin 46; links 40*c* and 40*d* are pivotally interconnected by a pin 48; and the free end of link 40*d* carries a pin 50. Pin 44 is pivotally mounted on glass bracket 36, pins 46 and 50 are slidably mounted in a slot 38*b* in slider plate 38, and pin 48 is slidably mounted in a slot 36*a* in bracket 36. As will be seen from a comparison of FIGS. 14 and 15, as the pin 20 reaches the end of primary slot portion 26*a*, continued forward movement of the slider plate 38 (in this case to the right as viewed in FIG. 15) has the effects of collapsing the scissors linkage and moving the bracket 36 and pane 14 outwardly into a flush position relative to the fixed panels with, again, this rearward lateral movement being accompanied by and accommodated by movement of the pins 20 and 21 into the rearwardly extending secondary slot portions 26*b*.

In the embodiment of the invention seen in FIGS. 16, 17 and 18, the lateral rearward movement of the moveable glass pane 14 into a position flush with the fixed panes is accomplished by cams 52 pivotally mounted to spaced locations on the fixed pane 12 and coacting with upward and downward extensions 20*a*, 28*a*, respectively, of the leading pins 20, 28. Specifically, and as best seen in FIGS. 17*a* though 17*e*, the cams 52 receive the upward extension 20*a* of the leading pin 20 and the downward extension 28*a* of the leading pin 28 and then gradually pivot about their pivot axes 52*a* to move the glass rearwardly and laterally into its flush position relative to the fixed panes with the lower pins 20/21 and the upper pins 28/29 again moving rearwardly and laterally in lateral slot portions to accompany and accommodate the rearward lateral movement of the pane 14. The lateral slot portions in this case would be somewhat oblique with respect to the primary longitudinal slot portion to accommodate the path of rearward movement of the pins as defined by the pivotal movement of the cam members.

All of the embodiments heretofore described are contemplated for use with the rear window of the cab of a pickup type motor vehicle. The embodiment seen in FIGS. 19-22 is intended for use with a mechanism of the "sunroof" type wherein a glass pane 60 is moved into and out of a position within an opening in the roof of a motor vehicle with the glass, as in the previous embodiment, undergoing initially a sliding movement into a position proximate the opening and thereafter undergoing a lateral movement into a position flush with a surrounding surface of the motor vehicle. The sliding window mechanism of the FIGS. 18-22 embodiment includes a pair of tracks 62 each defining a compound slot 64; a pair of brackets 66 secured to opposite edges of the pane 60 and carrying pins 68/69 for sliding receipt in slots 64; a slider 70 slidably mounted in each track 62; and a power mechanism including an electric motor 72 driving a cable system 74. The rear pin 69 of each window bracket 66 passes through the respective slots 64 for engagement with an oblique slot 70*a* in a respective slider 70 so that, as the window arrives at its closed position relative to the opening in the motor vehicle roof, the sliders 70 continue to move forwardly with the oblique cam slot 70*a* coacting with the pins 69 to move the glass pane laterally upwardly relative to the plane of the glass with the movement being accompanied and accommodated by movement of the pins 69 into the secondary slot portions 64*a*. Note that, in this case, the forward pins 68 are not received in sliders 70 but rather move into oblique portions 64*b* of compound slots 64 to move the forward end of the glass laterally upwardly as the rearward end is moved laterally upwardly by the movement of the pins 69 into the slot portion 64*a*.

The invention will be seen to provide a sliding glass assembly for a motor vehicle which is simple and efficient in operation and which facilitates the movement of the sliding pane to a position flush with an adjacent surface of the motor vehicle such, for example, as an adjacent surface defined by fixed panes in the rear window of the cab of the pickup type motor vehicle or an adjacent roof surface in the case of a sunroof.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A sliding window assembly comprising:

a sliding window pane including at least one pin;

a guide track mounting the sliding pane for longitudinal sliding movement between an open position and a closed position; and a lateral thrust mechanism including a compound slot and a slider linearly moveable in the track, the slider including a slot angled with respect to a longitudinal axis of the track, the pin movably disposed in the compound slot and the slider slot such that movement of the slider in the track moves the sliding pane between the open position wherein a plane of the sliding pane is generally parallel to and spaced from a plane of a fixed vehicle surface and the closed position wherein the plane of the sliding pane is generally flush with the fixed vehicle surface.

2. A sliding window assembly according to claim 1 wherein the compound slot has an "L" configuration with a primary portion constituting one leg of the "L" and an end portion substantially perpendicular to the primary portion constituting the other leg of the "L."

3. A sliding window assembly for use in a motor vehicle, the sliding window assembly comprising:

a slideable window pane movable between a closed position wherein a plane of the slideable pane is generally flush with a plane of a fixed pane and an open position wherein the plane of the slideable pane is spaced from and generally parallel to the plane of the fixed pane;

at least one guide pin secured to the slideable pane;

a fixed guide track;

a moveable guide structure linearly slideable in the fixed guide track and including a slot angled with respect to a longitudinal axis of said track;

the pin being moveably disposed in a compound slot and said slot of said moveable guide structure; and a drive mechanism connected to the moveable guide structure and operative to linearly move the moveable guide structure in the track with the pin positioned in a first portion of the compound slot to move the slideable pane along the fixed guide track in the longitudinal axis of the track direction generally parallel to a and with the pin positioned in a second portion of the compound slot to move the slideable pane laterally relative to the longitudinal axis of the track.

4. A sliding window assembly according to claim 3 wherein the first portion of the compound slot comprises an elongated primary portion generally parallel to the plane of the slidable pane and the second portion of the compound slot comprises an end portion extending at an angle to the primary portion.

5. A sliding window assembly according to claim 4 wherein the end portion is generally perpendicular to the primary portion.

6. The sliding window assembly of claim 5 wherein the moveable guide slot of said moveable guide structure has an angled lower surface which engages an end of the pin and raises the slideable pane with respect to the fixed pane as the slideable pane moves into the closed position.

7. A sliding window assembly comprising:

a slidable pane movable between an open position wherein a plane of said slideable pane is spaced from and generally parallel to a plane of a fixed pane and a closed position wherein said plane of said slideable pane is generally flush with said plane of said fixed pane;

at least one guide pin secured to the slidable pane;

a fixed guide track defining a compound slot moveably receiving a first portion of the pin; and a moveable guide structure linearly and slidably mounted in the fixed guide track and defining a slot moveably receiving a second portion of the pin, said slot of said moveable guide structure being angled with respect to a longitudinal axis of said track such that linear movement of said moveable guide structure in said track moves said slideable pane between said open and closed positions.

8. A vehicle sliding window for use in closing an opening defined by a fixed vehicle surface, the window comprising:

a moveable window pane defining a plane and having a guide pin connected to the pane;

a fixed guide track defining a compound slot having an elongate primary portion substantially parallel to a longitudinal axis of said track and a secondary portion angled with respect to the primary portion; and a slider plate linearly and slideably moveable in the fixed guide track, the slider plate defining a slot positioned oblique with respect to the primary portion of the compound slot, the pin being moveably disposed in said compound slot and said slot of said slider plate, wherein linear movement of said slider plate in said track moves said moveable window pane between an open position wherein the plane of said moveable pane is spaced from and generally parallel to a plane of the fixed vehicle surface and said pin is disposed in said primary portion of said compound slot and a closed position wherein the plane of said moveable pane is generally flush with the fixed vehicle surface and said pin is disposed in said secondary portion of said compound slot.

9. The sliding window of claim 8 wherein the slider plate slot has an angled lower surface which engages an end of the pin and raises the moveable pane with respect to the fixed vehicle surface as the moveable pane moves into the closed position.

10. The sliding window of claim 8 further comprising a motor having a cable attached thereto, the cable being connected to the slider plate for selectively moving the slider plate and the moveable window pane along the track.

11. The sliding window of claim 8 wherein an outer surface of the moveable pane is substantially flush with an outer surface of the fixed vehicle surface when said moveable pane is in said closed position.

* * * * *